US008475298B2

(12) United States Patent
Ogg et al.

(10) Patent No.: US 8,475,298 B2
(45) Date of Patent: Jul. 2, 2013

(54) GOLF BALL HAVING DUAL CORE DEFLECTION DIFFERENTIAL

(75) Inventors: Steve Ogg, Carlsbad, CA (US); David Bartels, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 13/451,160

(22) Filed: Apr. 19, 2012

(65) Prior Publication Data

US 2012/0202620 A1 Aug. 9, 2012

Related U.S. Application Data

(63) Continuation-in-part of application No. 13/091,937, filed on Apr. 21, 2011.

(60) Provisional application No. 61/330,127, filed on Apr. 30, 2010.

(51) Int. Cl.
*A63B 37/06* (2006.01)

(52) U.S. Cl.
USPC ..... 473/376

(58) Field of Classification Search
USPC ..... 473/376, 373, 374
See application file for complete search history.

(56) References Cited

U.S. PATENT DOCUMENTS 4,911,451 A 3/1990 Sullivan et al.
4,986,545 A 1/1991 Sullivan
5,048,838 A 9/1991 Chikaraishi et al.
5,252,652 A 10/1993 Egashira et al.
5,588,924 A 12/1996 Sullivan et al.
5,688,595 A 11/1997 Yamagishi et al.
5,721,304 A 2/1998 Pasqua
5,725,442 A 3/1998 Higuchi et al.
5,779,562 A 7/1998 Melvin et al.
5,816,937 A * 10/1998 Shimosaka et al. ..... 473/354
5,830,086 A 11/1998 Hayashi et al.
5,980,396 A 11/1999 Moriyama et al.
6,117,026 A 9/2000 Hayashi et al.
6,123,630 A 9/2000 Hayashi et al.
6,142,886 A 11/2000 Sullivan et al.
6,248,027 B1 6/2001 Hayashi et al.
6,251,031 B1 6/2001 Hayashi et al.
6,277,034 B1 8/2001 Nesbitt et al.
6,299,550 B1 10/2001 Molitor et al.
6,361,454 B1 3/2002 Yoshida et al.
6,461,251 B1 10/2002 Yamagishi et al.
6,468,169 B1 10/2002 Hayashi et al.
6,495,633 B1 12/2002 Sullivan et al.
6,520,870 B2 2/2003 Tzivanis et al.
6,565,455 B2 5/2003 Hayashi et al.
6,565,456 B2 5/2003 Hayashi et al.
6,626,770 B2 9/2003 Takemura et al.
6,653,382 B1 11/2003 Statz et al.

(Continued)

*Primary Examiner* — Raeann Gorden
(74) *Attorney, Agent, or Firm* — Michael A. Catania; Sonia Lari; Rebecca Hanovice

(57) ABSTRACT

A golf ball comprising a core comprising an inner core center and an outer core layer disposed over the inner core center. The inner core center has a deflection of greater than 0.210 inch under a load of 220 pounds and the core has a deflection ranging from 0.120 inch to 0.080 inch under a load of 220 pounds. An inner mantle layer is disposed over the core, an outer mantle is disposed over the inner mantle layer, and a cover is disposed over the outer mantle.

9 Claims, 3 Drawing Sheets

U.S. PATENT DOCUMENTS

| | | | |
|---|---|---|---|
| 6,685,579 | B2 | 2/2004 | Sullivan |
| 6,705,956 | B1 | 3/2004 | Moriyama et al. |
| 6,743,122 | B2 | 6/2004 | Hayashi et al. |
| 6,849,006 | B2 | 2/2005 | Cavallaro et al. |
| 6,994,638 | B2 | 2/2006 | Rajagopalan et al. |
| 7,121,959 | B1 | 10/2006 | Yoshida et al. |
| 7,226,367 | B2 | 6/2007 | Higuchi et al. |
| 7,335,114 | B2 | 2/2008 | Hebert et al. |
| 7,361,102 | B2 | 4/2008 | Ladd et al. |
| 7,537,531 | B2 | 5/2009 | Ladd et al. |
| 7,591,741 | B2 | 9/2009 | Sullivan et al. |
| 7,625,302 | B2 * | 12/2009 | Watanabe et al. ..... 473/376 |
| 7,874,939 | B2 | 1/2011 | Sullivan et al. |
| 8,025,593 | B2 | 9/2011 | Rajagopalan et al. |
| 8,109,843 | B2 | 2/2012 | Hebert et al. |

* cited by examiner

GOLF BALL HAVING DUAL CORE DEFLECTION DIFFERENTIAL

CROSS REFERENCES TO RELATED APPLICATIONS

The present application is a continuation-in-part application of U.S. patent application Ser. No. 13/091937, filed on Apr. 21, 2011, which claims priority to U.S. Provisional Patent application No. 61/330,127 field on Apr. 30, 2010, now abandoned, both of which are hereby incorporated by reference in their entireties.

STATEMENT REGARDING FEDERALLY SPONSORED RESEARCH OR DEVELOPMENT

Not Applicable

BACKGROUND OF THE INVENTION

1. Field of the Invention

The present invention relates to golf balls. Particularly to golf balls having five layers including a dual core, a dual mantle and a thermoplastic polyurethane cover.

2. Description of the Related Art

Sullivan et al., U.S. Pat. No. 4,911,451, for a Golf Ball Cover Of Neutralized Poly(ethylene-acrylic acid) Copolymer, discloses in Table One a golf ball having a compression of below 50 and a cover composed of ionomers having various Shore D hardness values ranging from 50 to 61.

Sullivan, U.S. Pat. No. 4,986,545, for a Golf Ball discloses a golf ball having a Rhiele compression below 50 and a cover having Shore C values as low as 82.

Egashira et al., U.S. Pat. No. 5,252,652, for a Solid Golf Ball, discloses the use of a zinc pentachlorothiophenol in a core of a golf ball.

Pasqua, U.S. Pat. No. 5,721,304, for a Golf Ball Composition, discloses a golf ball with a core having a low compression and the core comprising calcium oxide.

Sullivan, et al., U.S. Pat. No. 5,588,924, for a Golf Ball discloses a golf ball having a PGA compression below 70 and a COR ranging from 0.780 to 0.825.

Sullivan et al., U.S. Pat. No. 6,142,886, for a Golf Ball And Method Of Manufacture discloses a golf ball having a PGA compression below 70, a cover Shore D hardness of 57, and a COR as high as 0.794.

Tzivanis et al., U.S. Pat. No. 6,520,870, for a Golf Ball, discloses a golf ball having a core compression less than 50, a cover Shore D hardness of 55 or less, and a COR greater than 0.80.

The prior art fails to disclose a five layer golf ball with a dual core that produces a high spin for short game shots and low spin for driver shots.

BRIEF SUMMARY OF THE INVENTION

The present invention provides a golf ball with a dual core differential such that the golf ball produces a high spin for short game shots and low spin for driver shots for distance.

One aspect of the present invention is a golf ball comprising a core comprising an inner core center and an outer core layer disposed over the inner core center. The inner core center comprises a polybutadiene material and has a deflection of greater than 0.210 inch under a load of 100 kilograms. The core (the combination of the inner core and the outer core) has a deflection ranging from 0.130 inch to 0.105 inch under a load of 100 kilograms. An inner mantle layer is disposed over the core, an outer mantle layer is disposed over the inner mantle layer, and a cover is disposed over the outer mantle. The golf ball has a diameter ranging form 1.65 inches to 1.685 inches.

Another aspect of the present invention is a golf ball comprising a core comprising an inner core center and an outer core layer disposed over the inner core center. The inner core center comprises a polybutadiene material and has a deflection of greater than 0.210 inch under a load of 100 kilograms, wherein the core has a deflection ranging from 0.120 inch to 0.090 inch under a load of approximately 200 pounds. The core has a diameter ranging from 1.40 inches to 1.64 inches. An inner mantle layer is disposed over the core, an outer mantle layer is disposed over the inner mantle layer, and a cover is disposed over the outer mantle.

Yet another aspect of the present invention is a golf ball comprising a core comprising an inner core center and an outer core layer disposed over the inner core center. The inner core center comprises a polybutadiene material and has a deflection of greater than 0.210 inch under a load of 100 kilograms. The core has a deflection ranging from 0.120 inch to 0.095 inch under a load of 100 kilograms. The core has a diameter ranging from 1.40 inches to 1.64 inches. An inner mantle layer is disposed over the core, an outer mantle layer is disposed over the inner mantle layer, and a cover is disposed over the outer mantle.

Preferably, the golf ball cover is composed of a thermoplastic polyurethane/polyurea material. The golf ball cover preferably has a thickness ranging from 0.015 inch to 0.045 inch. Each mantle layer is preferably composed of an ionomer material. Alternatively, each mantle layer is composed of a blend of ionomer materials. Alternatively, at least one of the mantle layers is composed of a highly neutralized ionomer material. The combined mantle layers preferably have a thickness ranging from 0.030 inch to 0.075 inch, and most preferably less than 0.067 inch. The core preferably has a diameter ranging from 1.40 inches to 1.64 inches. Preferably, the golf ball has a coefficient of restitution greater than 0.79.

In another embodiment of the present invention the golf ball comprises a core comprising an inner core center and an outer core layer disposed over the inner core center. The inner core center comprises a polybutadiene material and has a deflection of greater than 0.210 inch under a load of 100 kilograms. The core (combination of the inner core and the outer core) has a deflection ranging from 0.120 inch to 0.095 inch under a load of 100 kilograms. The core has a deflection ranging from 0.120 inch to 0.090 inch under a load of 100 kilograms. An inner mantle layer is disposed over the core, an outer mantle is disposed over the inner mantle, and a cover is disposed over the outer mantle. The cover is composed of a thermoplastic polyurethane and has a thickness ranging from 0.015 inch to 0.030 inch. The golf ball has a diameter ranging from 1.65 inches to 1.685 inches.

Preferably, each mantle layer is composed of an ionomer material. Alternatively, each mantle layer is composed of a blend of ionomer materials. Alternatively, at least one of the mantle layer is composed of a highly neutralized ionomer material. Preferably, each mantle layer has a thickness ranging from 0.030 inch to 0.090 inch.

In yet another embodiment, the golf ball of the present invention comprises a core comprising an inner core center and an outer core layer disposed over the inner core center. The inner core center comprises a polybutadiene material and has a deflection of greater than 0.220 inch under a load of 100 kilograms, wherein the core (combination of the inner core and the outer core) has a deflection ranging from 0.120 inch to 0.090 inch under a load of 200 pounds. The core has a diameter ranging from 1.40 inches to 1.64 inches. An inner mantle layer is disposed over the core, an outer mantle is disposed over the inner mantle, and a cover is disposed over the outer mantle.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
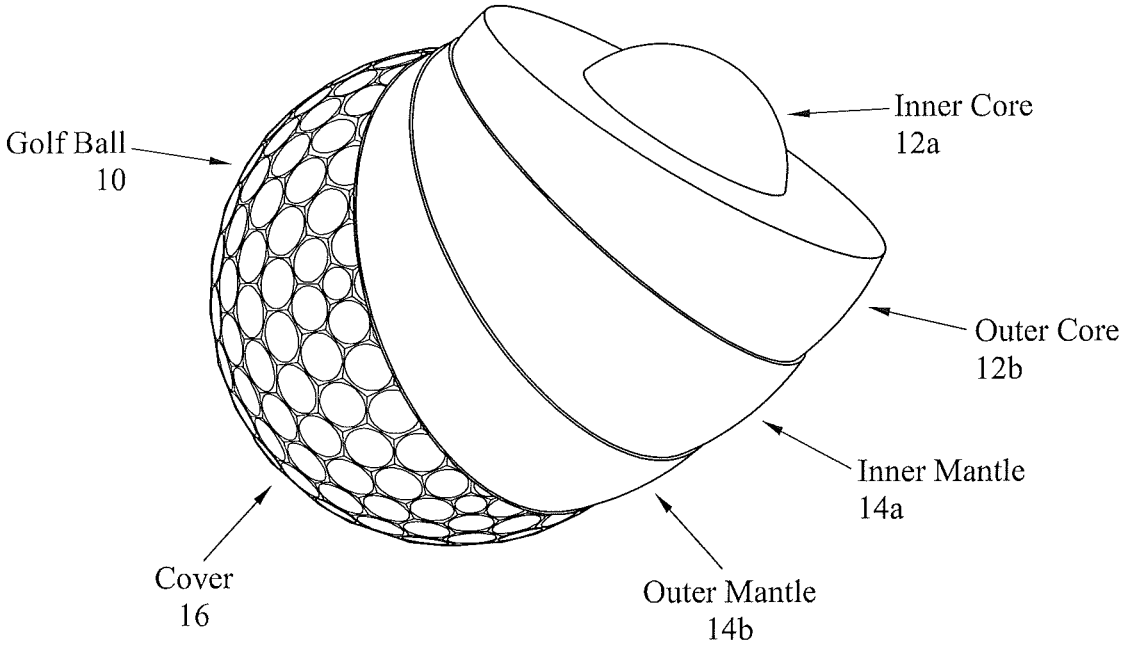
FIG. 1 is an exploded partial cut-away view of a golf ball.
Figure 2:
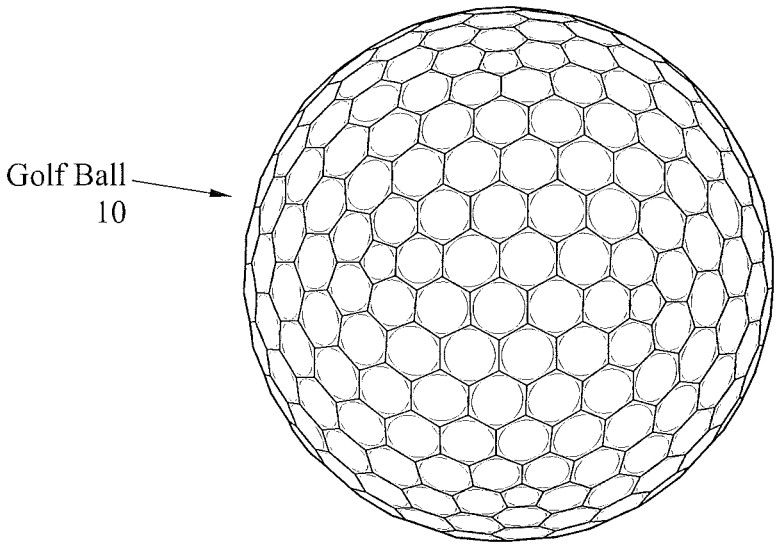
FIG. 2 is top perspective view of a golf ball.
Figure 3:
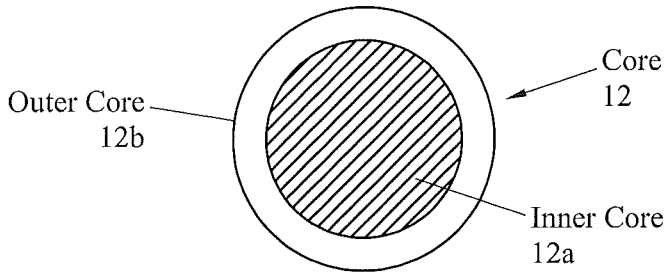
FIG. 3 is a cross-sectional view of a core component of a golf ball.
Figure 4:
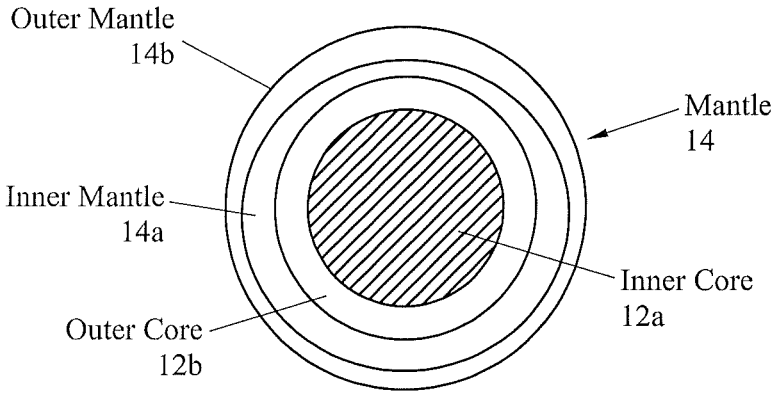
FIG. 4 is a cross-sectional view of a core component and a mantle component of a golf ball.
Figure 5:
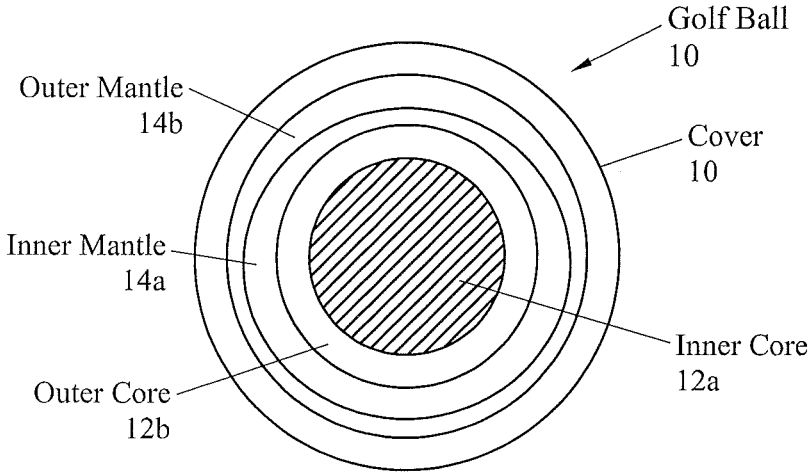
FIG. 5 is a cross-sectional view of an inner core layer, an outer core layer, an inner mantle layer, an outer mantle layer and a cover layer of a golf ball.

The present invention is directed to a golf ball comprising a dual-core component, a dual mantle component and a cover layer.

A preferred embodiment of a golf ball 10 is shown in FIGS. 1-5. The golf ball 10 comprises an inner core 12*a*, an outer core 12*b*, an inner mantle 14*a*, an outer mantle 14*b* and a cover 16. The golf ball 10 preferably has a diameter of at least 1.68 inches, a mass ranging from 45 grams to 47 grams, a COR of at least 0.79, a deformation under a 100 kilogram loading of at least 0.07 mm.

The cover 16 is preferably composed of a thermoplastic polyurethane material, and preferably has a thickness ranging from 0.025 inch to 0.04 inch, and more preferably ranging from 0.03 inch to 0.04 inch. The material of the cover 16 preferably has a Shore D plaque hardness ranging from 30 to 60, and more preferably from 40 to 50. The Shore D hardness measured on the cover 16 is preferably less than 56 Shore D. Preferably the cover 16 has a Shore A hardness of less than 96. Alternatively, the cover 16 is composed of a thermoplastic polyurethane/polyurea material. One example is disclosed in U.S. Pat. No. 7,367,903 for a Golf Ball, which is hereby incorporated by reference in its entirety.

The mantle component 14 is composed of the inner mantle layer 14*a* and the outer mantle layer 14*b*. The mantle component 14 preferably has a thickness ranging from 0.05 inch to 0.15 inch, and more preferably from 0.06 inch to 0.08 inch. The outer mantle layer 14*b* is preferably composed of a blend of ionomer materials. One preferred embodiment comprises SURLYN 9150 material, SURLYN 8940 material, a SURLYN AD 1022 material, and a masterbatch. The SURLYN 9150 material is preferably present in an amount ranging from 20 to 45 weight percent of the cover, and more preferably 30 to 40 weight percent. The SURLYN 8945 is preferably present in an amount ranging from 15 to 35 weight percent of the cover, more preferably 20 to 30 weight percent, and most preferably 26 weight percent. The SURLYN 9945 is preferably present in an amount ranging from 30 to 50 weight percent of the cover, more preferably 35 to 45 weight percent, and most preferably 41 weight percent. The SURLYN 8940 is preferably present in an amount ranging from 5 to 15 weight percent of the cover, more preferably 7 to 12 weight percent, and most preferably 10 weight percent.

SURLYN 8320, from DuPont, is a very-low modulus ethylene/methacrylic acid copolymer with partial neutralization of the acid groups with sodium ions. SURLYN 8945, also from DuPont, is a high acid ethylene/methacrylic acid copolymer with partial neutralization of the acid groups with sodium ions. SURLYN 9945, also from DuPont, is a high acid ethylene/methacrylic acid copolymer with partial neutralization of the acid groups with zinc ions. SURLYN 8940, also from DuPont, is an ethylene/methacrylic acid copolymer with partial neutralization of the acid groups with sodium ions.

The inner mantle layer 14*a* is preferably composed of a blend of ionomers, preferably comprising a terpolymer and at least two high acid (greater than 18 weight percent) ionomers neutralized with sodium, zinc, magnesium, or other metal ions. The material for the inner mantle layer preferably has a Shore D plaque hardness ranging preferably from 35 to 77, more preferably from 36 to 44, a most preferably approximately 40. The thickness of the outer mantle layer preferably ranges from 0.025 inch to 0.050 inch, and is more preferably approximately 0.037 inch. The mass of an insert including the dual core and the inner mantle layer preferably ranges from 32 grams to 40 grams, more preferably from 34 to 38 grams, and is most preferably approximately 36 grams. The inner mantle layer 14*b* is alternatively composed of a HPF material available from DuPont. Alternatively, the inner mantle layer 14*b* is composed of a material such as disclosed in Kennedy, III et al., U.S. Pat. No. 7,361,101 for a Golf Ball And Thermoplastic Material, which is hereby incorporated by reference in its entirety.

The outer mantle layer 14*b* is preferably composed of a blend of ionomers, preferably comprising at least two high acid (greater than 18 weight percent) ionomers neutralized with sodium, zinc, or other metal ions. The blend of ionomers also preferably includes a masterbatch. The material of the outer mantle layer 14*b* preferably has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. The mass of the entire insert including the core 12, the inner mantle layer 14*a* and the outer mantle layer 14*b* preferably ranges from 38 grams to 43 grams, more preferably from 39 to 41 grams, and is most preferably approximately 41 grams.

In an alternative embodiment, the inner mantle layer 14*a* is preferably composed of a blend of ionomers, preferably comprising at least two high acid (greater than 18 weight percent) ionomers neutralized with sodium, zinc, or other metal ions. The blend of ionomers also preferably includes a masterbatch. In this embodiment, the material of the inner mantle layer 14*a* has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. Also in this embodiment, the outer mantle layer 14*b* is composed of a blend of ionomers, preferably comprising a terpolymer and at least two high acid (greater than 18 weight percent) ionomers neutralized with sodium, zinc, magnesium, or other metal ions. In this embodiment, the material for the outer mantle layer 14*b* preferably has a Shore D plaque hardness ranging preferably from 35 to 77, more preferably from 36 to 44, a most preferably approximately 40. The thickness of the outer mantle layer 14*b* preferably ranges from 0.025 inch to 0.100 inch, and more preferably ranges from 0.070 inch to 0.090 inch.

In yet another embodiment wherein the inner mantle layer 14*a* is thicker than the outer mantle layer 14*b* and the outer mantle layer 14*b* is harder than the inner mantle layer 14*a*, the inner mantle layer 14*a* is composed of a blend of ionomers, preferably comprising a terpolymer and at least two high acid (greater than 18 weight percent) ionomers neutralized with sodium, zinc, magnesium, or other metal ions. In this embodiment, the material for the inner mantle layer 14*a* has a Shore D plaque hardness ranging preferably from 30 to 77, more preferably from 30 to 50, and most preferably approximately 40. In this embodiment, the material for the outer mantle layer 14*b* has a Shore D plaque hardness ranging preferably from 40 to 77, more preferably from 50 to 71, and most preferably approximately 67. In this embodiment, the thickness of the inner mantle layer 14*a* preferably ranges from 0.030 inch to 0.090 inch, and the thickness of the outer mantle layer 14*b* ranges from 0.025 inch to 0.070 inch.

Preferably the inner core 12*a* has a diameter ranging from 0.75 inch to 1.20 inches, more preferably from 0.85 inch to 1.05 inch, and most preferably approximately 0.95 inch. Preferably the inner core 12*a* has a Shore D hardness ranging from 20 to 50, more preferably from 25 to 40, and most preferably approximately 35. Preferably the inner core is formed from a polybutadiene, zinc diacrylate, zinc oxide, zinc stearate, a peptizer and peroxide. Preferably the inner core has a mass ranging from 5 grams to 15 grams, 7 grams to 10 grams and most preferably approximately 8 grams.

Preferably the outer core 12*b* has a diameter ranging from 1.25 inch to 1.55 inches, more preferably from 1.40 inch to 1.5 inch, and most preferably approximately 1.5 inch. Preferably the inner core has a Shore D surface hardness ranging from 40 to 65, more preferably from 50 to 60, and most preferably approximately 56. Preferably the inner core is formed from a polybutadiene, zinc diacrylate, zinc oxide, zinc stearate, a peptizer and peroxide. Preferably the combined inner core and outer core have a mass ranging from 25 grams to 35 grams, 30 grams to 34 grams and most preferably approximately 32 grams.

Figure 6:
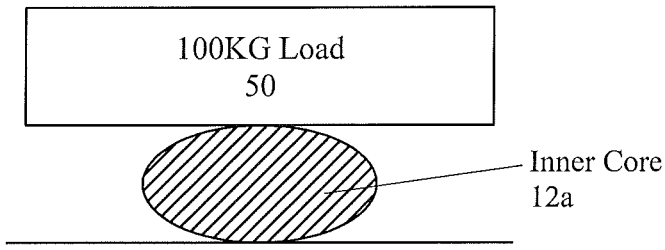
FIG. 6 is a cross-sectional view of an inner core layer under a 100 kilogram load.
Figure 7:
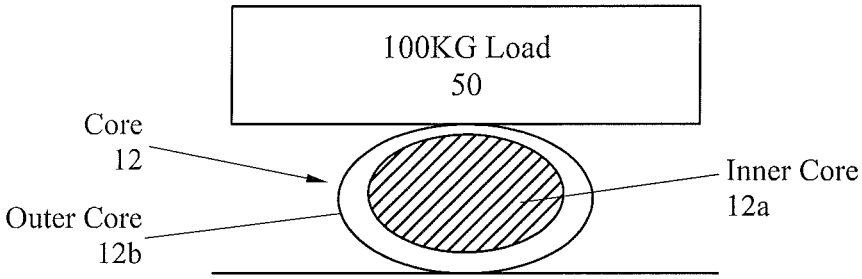
FIG. 7 is a cross-sectional view of a core under a 100 kilogram load.

Preferably the inner core 12*a* has a deflection of at least 0.230 inch under a load of 220 pounds, and the core 12 has a deflection of at least 0.080 inch under a load of 200 pounds. As shown in FIGS. 6 and 7, a mass 50 is loaded onto an inner core 12*a* and a core 12. As shown in FIGS. 6 and 7, the mass is 100 kilograms, approximately 220 pounds. Under a load of 100 kilograms, the inner core 12*a* preferably has a deflection from 0.230 inch to 0.300 inch. Under a load of 100 kilograms, preferably the core 12 has a deflection of 0.08 inch to 0.150 inch. Alternatively, the load is 200 pounds (approximately 90 kilograms), and the deflection of the core 12 is at least 0.080 inch. Further, a compressive deformation from a beginning load of 10 kilograms to an ending load of 130 kilograms for the inner core 12*a* ranges from 4 millimeters to 7 millimeters and more preferably from 5 millimeters to 6.5 millimeters. The dual core deflection differential allows for low spin off the tee to provide greater distance, and high spin on approach shots.

In a particularly preferred embodiment of the invention, the golf ball preferably has an aerodynamic pattern such as disclosed in Simonds et al., U.S. Pat. No. 7,419,443 for a Low Volume Cover For A Golf Ball, which is hereby incorporated by reference in its entirety. Alternatively, the golf ball has an aerodynamic pattern such as disclosed in Simonds et al., U.S. Pat. No. 7,338,392 for An Aerodynamic Surface Geometry For A Golf Ball, which is hereby incorporated by reference in its entirety. Alternatively, the golf ball has an aerodynamic pattern such as disclosed in Simonds et U.S. Pat. No. 7,468,007 for a Dual Dimple Surface Geometry For A Golf Ball, which is hereby incorporated by reference in its entirety.

Various aspects of the present invention golf balls have been described in terms of certain tests or measuring procedures. These are described in greater detail as follows.

As used herein, "Shore D hardness" of the golf ball layers are measured generally in accordance with ASTM D-2240 type D, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore D hardness of the cover is measured while the cover remains over the mantles and cores. When a hardness measurement is made on the golf ball, the Shore D hardness is preferably measured at a land area of the cover.

As used herein, "Shore A hardness" of a cover is measured generally in accordance with ASTM D-2240 type A, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore A hardness of the cover is measured while the cover remains over the mantles and cores. When a hardness measurement is made on the golf ball, Shore A hardness is preferably measured at a land area of the cover The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head speed, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the COR and the surface configuration of the ball.

The coefficient of restitution is the ratio of the outgoing velocity to the incoming velocity. In the examples of this application, the coefficient of restitution of a golf ball was measured by propelling a ball horizontally at a speed of 125+/−5 feet per second (fps) and corrected to 125 fps against a generally vertical, hard, flat steel plate and measuring the ball's incoming and outgoing velocity electronically. Speeds were measured with a pair of ballistic screens, which provide a timing pulse when an object passes through them. The screens were separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

The measurements for deflection, compression, hardness, and the like are preferably performed on a finished golf ball as opposed to performing the measurement on each layer during manufacturing.

Preferably, in a five layer golf ball comprising an inner core, an outer core, an inner mantle layer, an outer mantle layer and a cover, the hardness/compression of layers involve an inner core with the greatest deflection (lowest hardness), an outer core (combined with the inner core) with a deflection less than the inner core, an inner mantle layer with a hardness less than the hardness of the combined outer core and inner core, an outer mantle layer with the hardness layer of the golf ball, and a cover with a hardness less than the hardness of the outer mantle layer. These measurements are preferably made on a finished golf ball that has been torn down for the measurements.

Preferably the inner mantle layer is thicker than the outer mantle layer or the cover layer. The dual core and dual mantle golf ball creates an optimized velocity-initial velocity ratio (Vi/IV), and allows for spin manipulation. The dual core provides for increased core compression differential resulting in a high spin for short game shots and a low spin for driver shots. A discussion of the USGA initial velocity test is disclosed in Yagley et al., U.S. Pat. No. 6,595,872 for a Golf Ball With High Coefficient Of Restitution, which is hereby incorporated by reference in its entirety. Another example is Bartels et al., U.S. Pat. No. 6,648,775 for a Golf Ball With High Coefficient Of Restitution, which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf ball comprising:

a core comprising an inner core and an outer core disposed over the inner core, the inner core having a deflection of at least 0.210 inch under a load of 100 kilograms, the outer core having a Shore D hardness ranging from 50 to 60 and the core having a deflection ranging from 0.120 inch to 0.095 inch under a load of 100 kilograms;

an inner mantle layer disposed over the outer core, the inner mantle layer having a thickness ranging from 0.070 inch to 0.090 inch, the inner mantle layer material having a plaque Shore D hardness ranging from 36 to 44;

an outer mantle layer disposed over the inner mantle layer, the outer mantle layer having a thickness ranging from 0.025 inch to 0.040 inch, the outer mantle layer composed of an ionomer material, the outer mantle layer material having a plaque Shore D hardness ranging from 65 to 71; and a cover layer disposed over the outer mantle layer, the cover having a thickness ranging from 0.025 inch to 0.040 inch, the cover composed of a thermoplastic polyurethane material, the cover material having a plaque Shore D hardness ranging from 40 to 50, and the on cover Shore D hardness less than 56;

wherein a dual core deflection differential of the inner core having a deflection of at least 0.210 inch under a load of 100 kilograms and the core having a deflection ranging from 0.120 inch to 0.095 inch under a load of 100 kilograms allows for a low spin of a golf ball hit off a tee to provide greater distance, and a high spin of a golf ball hit on approach shots, wherein the golf ball has a coefficient of restitution of at least 0.79 and a deformation of at least 0.07 mm under a 100 kilogram loading.

2. The golf bail according to claim 1 wherein the outer core is composed of a polybutadiene material, organic peroxide, zinc stearate, zinc diacrylate and zinc oxide.

3. The golf ball according to claim 1 wherein the inner core is composed of a polybutadiene material, organic peroxide, zinc stearate, zinc diacrylate and zinc oxide.

4. The golf ball according to claim 1 wherein the inner mantle is composed of a fully neutralized polymer material.

5. A golf ball comprising:

a core comprising an inner core and an outer core disposed over the inner core, the inner core having a deflection of at least 0.210 inch under a load of 100 kilograms, and the core having a deflection ranging from 0.120 inch to 0.095 inch under a load of 100 kilograms, the outer core having a Shore D hardness ranging from 50 to 60, wherein the core has a diameter ranging from 1.40 inches to 1.64 inches;

an inner mantle layer disposed over the outer core, the inner mantle layer having a thickness ranging from 0.030 inch to 0.090 inch, the inner mantle layer material having a plaque Shore D hardness ranging from 30 to 44;

an outer mantle layer disposed over the inner mantle layer, the outer mantle layer having a thickness ranging from 0.025 inch to 0.070 inch, the outer mantle layer material having a plaque Shore D hardness ranging from 50 to 71, wherein the inner mantle is thicker than the outer mantle and the outer mantle is harder than the inner mantle; and a cover layer disposed over the outer mantle layer, the cover having a thickness ranging from 0.025 inch to 0.050 inch, wherein the cover has a Shore D hardness less than the hardness of the outer mantle layer;

wherein a dual core deflection differential of the inner core having a deflection of at least 0.210 inch under a load of 100 kilograms and the core having a deflection ranging from 0.120 inch to 0.095 inch under a load of 100 kilograms allows for a low spin of a golf ball hit off a tee to provide greater distance, and a high spin of a golf ball hit on approach shots, wherein the golf ball has a coefficient of restitution of at least 0.79 and a deformation of at least 0.07 mm under a 100 kilogram loading.

6. The golf ball according to claim 5 wherein the cover material has a plaque Shore A hardness less than 96.

7. The golf ball according to claim 5 wherein the cover material is composed of a thermoplastic polyurethane material.

8. The golf ball according to claim 5 wherein the cover material is composed of a thermoplastic polyurea material.

9. The golf ball according to claim 5 wherein the cover material is composed of a thermoplastic polyurethane/polyurea material.

* * * * *